United States Patent [19]

Henderson et al.

[11] Patent Number: 4,955,834

[45] Date of Patent: Sep. 11, 1990

[54] RECESSED TROLLING MOTOR MOUNTING

[75] Inventors: William A. Henderson, Tulsa; Isaac H. Nelson, Owasso, both of Okla.

[73] Assignee: Zebco Corporation, Tulsa, Okla.

[21] Appl. No.: 231,758

[22] Filed: Aug. 12, 1988

[51] Int. Cl.[5] ..... B63H 21/26

[52] U.S. Cl. ..... 440/63; 248/642; 440/6; 440/53

[58] Field of Search ..... 440/6, 53, 54, 61, 63; 114/343, 355; 248/640, 641, 642

[56] References Cited

U.S. PATENT DOCUMENTS

| | | | |
|---|---|---|---|
| 1,659,580 | 2/1928 | Weller | 440/53 |
| 2,119,281 | 5/1938 | Luders | 440/53 |
| 2,901,194 | 8/1959 | Shontz | 248/642 |
| 2,905,132 | 9/1959 | Lewis et al. | 440/63 |
| 3,954,080 | 5/1976 | Weaver | 440/63 |
| 4,033,530 | 7/1977 | Harris | 248/642 |
| 4,129,088 | 12/1978 | Foley | 440/63 |
| 4,410,161 | 10/1983 | Booty | 440/63 |

FOREIGN PATENT DOCUMENTS

| | | | |
|---|---|---|---|
| 1129478 | 10/1968 | United Kingdom | 440/54 |

*Primary Examiner*—Sherman Basinger
*Assistant Examiner*—Thomas J. Brahan
*Attorney, Agent, or Firm*—Wood,Phillips,Mason,Recktenwald & VanSanten

[57] ABSTRACT

An outboard motor mount is provided for a boat having a hull defining an inside area to be occupied by a user. The motor is mounted for movement relative to the boat between an operative position wherein a propeller on the motor is submerged in the water and a storage position wherein the outboard motor resides substantially entirely within the inside area of the hull. It is possible with the inventive structure for the user to pivot the outboard motor in one motion back and further between the operative and storage positions without necessitating assembly/disassembly of the trolling motor. In the storage position, the motor resides conveniently within the inside area defined by the hull. When use of the motor is desired, a simple pivoting action replaces the motor in its operative position.

5 Claims, 2 Drawing Sheets

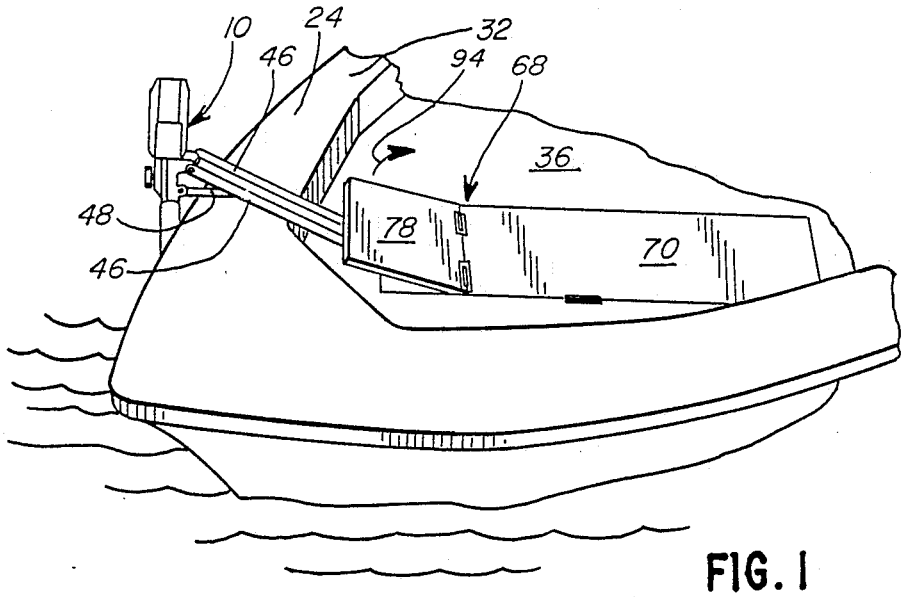
FIG. 1
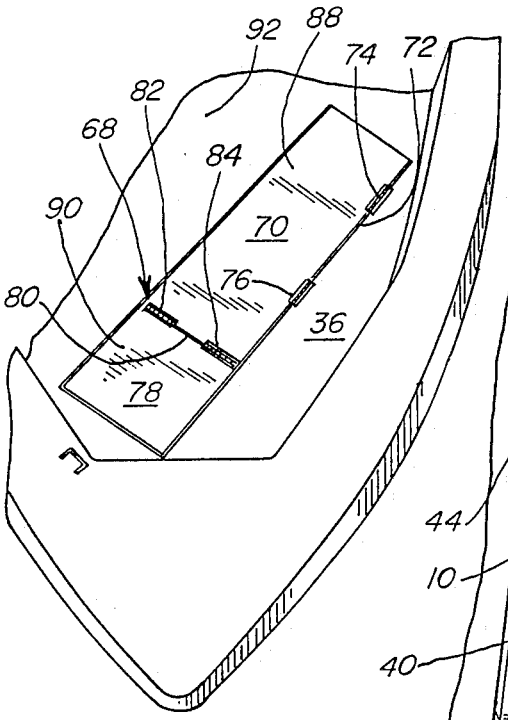
FIG. 2
FIG. 3
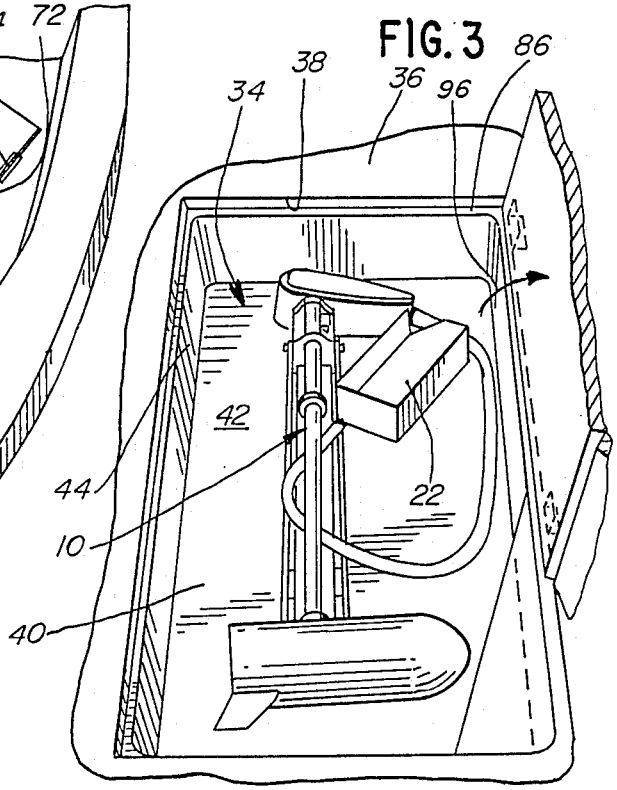

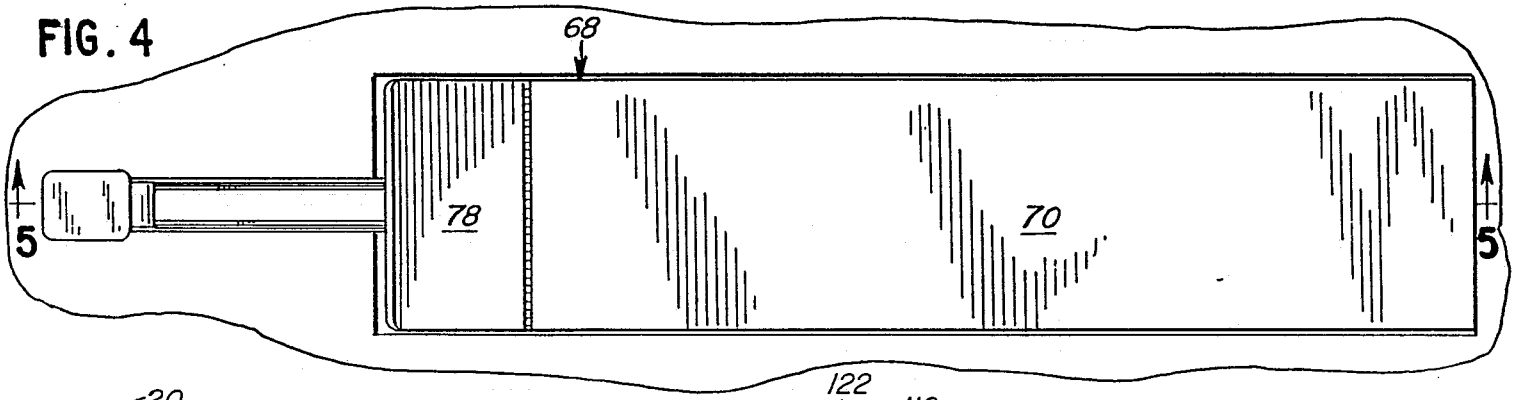
FIG. 4
FIG. 6
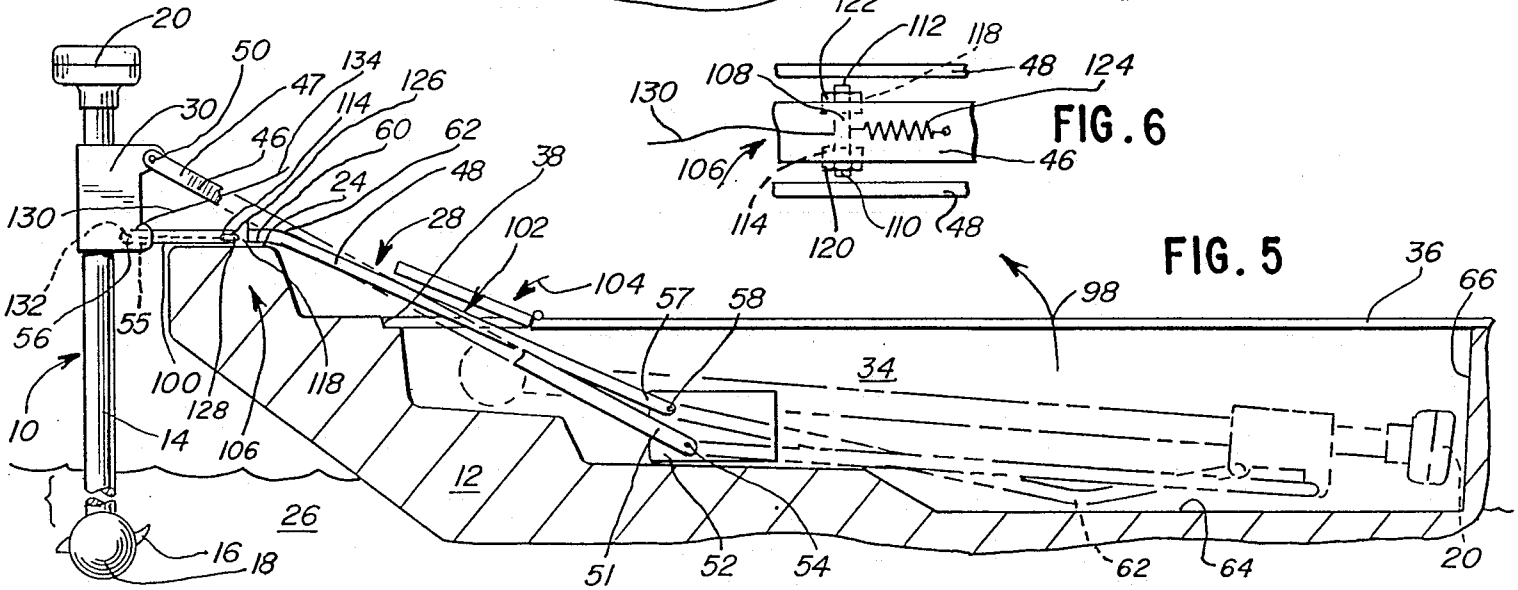
FIG. 5

RECESSED TROLLING MOTOR MOUNTING

BACKGROUND OF THE INVENTION

1. Field of the Invention

This invention relates to outboard motors, such as electric trolling motors, and, more particularly, to structure for mounting a trolling motor movably relative to a boat between operative and storage positions.

2. Background Art

It is known to provide a mounting bracket for a trolling motor that permits the motor to be pivoted between an operative position, wherein the drive propeller is submerged in the water, and a storage position, wherein the motor is entirely out of the water, as against the boat gunwale. An exemplary structure is shown in U.S. Reissue Pat. No. 28,176, to Horton.

One of the principal drawbacks with prior art structures such as that in Horton, is that the trolling motor in its stored position is in the way of the user of the boat. The only way to overcome this problem is to detach the trolling motor from the boat and store it in a convenient place. Disassembly is time consuming and inconvenient.

Even with the trolling motor disassembled and placed in a relatively convenient spot in the boat, the motor takes up a substantial amount of space, which in boats of the size normally utilizing an electric trolling motor, is at a premium.

Another problem with a structure such as that disclosed in Horton is that in the operating position for the trolling motor, the trolling motor is free to pivot upwardly. This is particularly a problem with the trolling motor situated as in FIG. 2 of Horton, wherein the drive propeller tends during operation to pivot the entire motor out of the water, which is obviously undesirable.

SUMMARY OF THE INVENTION

The present invention is specifically directed to overcoming the above enumerated problems in a novel and simple manner.

According to the invention, an outboard motor mount is provided for a boat having a hull defining an inside area to be occupied by a user. The motor is mounted for movement relative to the boat between an operative position wherein a drive propeller on the motor is submerged in the water and a storage position wherein the outboard motor resides substantially entirely within the inside area of the hull.

It is possible with the inventive structure for the user to pivot the outboard motor in one motion back and further between the operative and storage positions without necessitating assembly/disassembly of the trolling motor. In the storage position, the motor resides conveniently within the inside area defined by the hull. When use of the motor is desired, a simple pivoting action replaces the motor in its operative position.

In a preferred form, the boat has a floor and a recess beneath the floor with an opening in the floor communicating with the recess. In the storage position, the motor is substantially entirely within the recess so as to be conveniently stowed out of the way of the boat user.

The invention also contemplates a cover for the floor opening operable both with the outboard motor in its storage and operating positions. The cover preferably consists of two cooperating elements One of the cover elements is connected to the boat for pivoting movement relative thereto between an open position, wherein the floor opening is exposed, and a closed position, wherein at least a part of the floor opening is covered by the first element. The second element is mounted movably relative to the first element. With the motor in the storage position, the first and second cover elements can be made to cooperatively completely close the floor opening. With the motor in its operating position, the mounting structure therefor extends through the opening. The second cover element can be pivoted relative to the one cover element to expose a sufficient portion of the floor opening to accommodate the outboard motor mounting structure. With the motor conveniently mounted in the recess and the cover in place, the floor will be uninterrupted over the recess.

Another aspect of the invention is the provision of cooperating structure on the motor mounting structure and boat to releasably latch the motor in its operating position. A spring-loaded pin on the motor mounting structure seats in a recess in a bracket on the boat automatically upon the motor being moved into its operating position. By manually releasing the pin from the recess, the motor can be pivoted out of its operating position.

In a preferred form, the mounting structure for the trolling motor consists of first and second links, with the first link having a first portion rotatable relative to the motor about a first axis and a second portion rotatable relative to the boat about a second axis The second link has a first portion rotatable relative to the motor about a third axis and a second portion rotatable relative to the boat about a fourth axis. The first, second, third and fourth axes are preferably parallel. In a preferred form, the first axis is above the third axis, which is in turn above the second and fourth axes with the motor in its operating position state. The fourth axis is above the second axis and the distance between the first and second axes is greater that the distance between the third and fourth axes.

With the described linkage, the motor is readily maneuverable between its operating and storage position.

BRIEF DESCRIPTION OF THE DRAWINGS

FIG. 1 is a front perspective view of the bow portion of a boat having a trolling motor mounted thereon according to the present invention and with the motor in an operating position;

FIG. 2 is a plan view of the bow of the boat with the motor in a storage position in a receptacle beneath the boat floor and a cover for an opening in the boat floor in communication with the receptacle shown in a closed position;

FIG. 3 is an enlarged, fragmentary perspective view of the motor in its storage position in the receptacle with the cover in its open state;

FIG. 4 is an enlarged, fragmentary plan view of the bow of the boat and motor as shown in FIG. 1;

FIG. 5 is an enlarged, section view of the boat and motor taken along line 5—5 of FIG. 4; and FIG. 6 is an enlarged, fragmentary plan view of structure for mounting the motor to the boat and showing a latch to releasably maintain the motor in its operating position.

DETAILED DESCRIPTION OF THE DRAWINGS

The present invention is concerned with structure for mounting a conventional style trolling motor 10 to a boat 12 for movement relative to the boat between an operative position, shown in solid lines in FIG. 5, and a storage position, shown in phantom in FIG. 5.

The trolling motor 10 shown in FIG. 5 is exemplary of one type of outboard motor with which the present invention is operable. The precise configuration of the trolling motor 10 is, however, not critical to the present invention. Generally, the trolling motor 10 consists of a vertically extending shaft 14, which is rotatable about a vertical axis, a propeller 16 on a lower unit 18 for the motor 10 at the bottom of the shaft 14 and a control head 20 at the upper end of the shaft 14. An optional foot control 22 is shown in FIG. 3 to operate the motor 10.

The motor 10 is supported from one sidewall 24 of the boat 12 so that the lower unit 18 and propeller 16 are submerged in a body of water 26 on which the boat 12 is buoyed. The motor 10 is held in a desired position on the boat 12 by a linkage 28, which will be described in detail hereafter.

In operation, the shaft 14 rotates relative to a bracket 30 carried at one end of the linkage 28. The shaft 14, propeller 16, lower unit 18 and control head 20 rotate as a unit to control the direction of propulsion.

It is common for trolling motors such as that shown at 10 to be pulled out of the water so that the boat can operate normally at high speed. Whereas normally the motor 10 would be repositioned and possibly releasably fixed to the side wall gunwale 32, the present invention contemplates removably situating the motor 10 in a recess 34 beneath a floor 36 at the front of the boat 12. The front location is only exemplary as the recess 34 could be anywhere in the boat 12.

The boat floor 36 is substantially flat and has a rectangular opening 38 to establish communication with the recess 34. Within the recess 34 is an upwardly opening motor receptacle 40 consisting of a bottom wall 42 and a peripheral wall structure 44 extending upwardly from the bottom wall 42. The receptacle 40 has a depth sufficient to receive the motor 10 without the motor 10 protruding upwardly through the floor opening 38. The length of the opening 38 is aligned with the line of pivoting of the motor 10 between its operating and storage positions.

To mount the motor for pivoting movement between its operating and storage positions, first and second links 46, 48 are provided. Preferably a like link 46 is provided on each side of the link 48, however for purposes of the description herein, the two links 46 will be treated as a single link. The first link 46 has its one end 47 pivotally connected to the bracket 30 for rotation about a first axis 50 while the opposite end 51 of the link 46 is pivotally connected to a support block 52 within the recess 34 for pivoting movement about a second axis 54.

The second link 48 has one end 55 pivotally connected to the bracket 30 for rotation relative to the bracket about a third pivot axis 56 while the opposite end 57 of the link 48 is connected to the block 52 for rotation about a fourth axis 58. The first, second, third and fourth axes 50, 54, 56, 58 consecutively, are substantially parallel to each other. The distance between the first and third pivot axes 50, 56 is greater than the distance between the second and fourth pivot axes 54, 58. The distance between the first and second pivot axes 50, 54 is greater than the distance between the third and fourth pivot axes 56, 58.

Upon the motor 10 being urged in a clockwise direction in FIG. 5 from the solid line, operating position, the linkage permits the motor 10 to reposition to the phantom line position in FIG. 5, wherein the entire motor 10 and mounting structure therefor, to include the bracket 30 and links 46, 48, reside entirely within the recess 34.

The link 48 has an offset 60 defining an elbow 62, which abuts the bottom, upwardly facing surface 64 of the receptacle 40 to arrest rotation of the motor 10 and associated mounting structure and maintain the motor 10 in its storage position. The elbow 62 maintains the control head 20 above the surface 64 so as to prevent damage thereto. The control head 20, with the motor 10 in the storage position, is also spaced slightly from the forwardly facing wall surface 66 of the receptacle 40. Thus, in the storage position for the motor 10, the motor 10 is supported cooperatively by the ends 47, 55 of the links 46, 48 attached to the block 52 and the elbow 62 on the link 48 bearing on the surface 64.

The invention also contemplates that the opening 38 be selectively closed by a cover 68. The cover 68 consists of a main, rectangular section 70, which has one edge 72 mounted for pivotable movement relative to the floor 36 by spaced hinges 74, 76, and a second cover section 78 mounted for pivoting movement relative to the forward edge 80 of the main cover section 70 by hinges 82, 84.

With the motor in the FIG. 3 storage position, the door sections 70, 78 can both be fully closed, as shown in FIG. 2, to cooperatively seal the opening 38. When closed, the cover sections 70, 78 abut an upwardly facing peripheral edge 86 on the upper portion of the receptacle 40. The cover sections 70, 78 have a thickness chosen so that the upper surfaces 88, 90 respectively thereon are flush with the upwardly facing surface 92 of the floor 36.

To set the motor 10 up in its operating position, the door section 78 is pivoted in the direction of arrow 94 in FIG. 1 relative to the door section 70 after which the door section 70 is pivoted in the direction of arrow 96 in FIG. 3 to its open state. The user then grasps the motor 10 and pivots the motor 10 relative to the block 52 from the phantom line position in FIG. 5 in the direction of arrow 98 (FIG. 5) until an underside surface 100 on the link offset 60 is in close proximity to the gunwale 32, whereupon further clockwise pivoting in FIG. 5 is arrested and the motor 10 is properly situated in its operating position.

As seen in FIG. 5, with the motor 10 in its operating position, a portion 102 of the mounting structure for the motor 10 projects through the floor opening 38. The provision of the second cover section 78 permits the main cover section 70 to be moved to its closed position over the floor opening 38 and accommodates the mounting structure portion 102. With the main cover section 70 closed, the second cover section 78 can be pivoted in the direction of arrow 104 against the mounting portion 102 projecting through the floor opening 38. Thus, substantially the entire opening 38 is closed even with the motor 10 in its operating state.

With the inventive structure, the motor 10 can be simply maneuvered between its operating and storage positions, without requiring any assembly/disassembly of the motor 10 and/or mounting structure therefor. The motor 10 and associated mounting structure, with the motor 10 in its storage position, are stowed conveniently out of the way of the user of the boat. With the cover 68 closed over the stored motor 10, the floor 36 is uninterrupted. With the motor 10 in the operating state, the majority of the opening 3B is closed by the cover section 70.

Another aspect of the invention is the provision of a latch mechanism to maintain the motor lo in its operating position. The latch mechanism is shown in detail in FIGS. 5 and 6, at 106 The latch mechanism consists of a pin 108 extending through the link 46 so that the pin 108 ends 110, 112 project oppositely from the link 46. The pin 108 is movable lengthwise of the link 46 within elongate guide slots 114, 116 defined in the link 46.

A bracket 118 is mounted on the gunwale 32. The bracket 108 has spaced ramp plates 120, 122 which intercept the pin ends 110, 112 respectively as the motor 10 is pivoted to its operating state. The pin 108 is normally biased by a coil spring 124 towards the right side of the slots 114, 116 in FIG. 6. Upon the link 46 moving downwardly, the pin ends 110, 112 encounter ramp surfaces 126 (one shown) on the plates 120, 122. The ramp surfaces 126 progressively urge the pin 108 towards the left in FIG. 6 until the pin ends 110, 112 align with recesses 128 (one shown) in the ramp plates 120, 122, whereupon the spring 124 urges the pin ends 110, 112 into the recesses 128, to the right in FIGS. 5 and 6, so that pivoting of the link 46 is prevented.

To release the pin 108, a length of rope 130 is provided. The rope is connected to the pin 108 and extends around a pivot pin 132 connecting the link 48 to the bracket 30 and towards the inside of the boat 12. By drawing on the free end 134 of the rope 130, the pin 108 is drawn against the spring 124 out of the receptive recesses 128 to thereby permit clockwise pivoting of the link 48 away from the solid line position in FIG. 5.

It should be understood that the foregoing disclosure of specific embodiments is intended only to be illustrative of the broad concepts comprehended by the invention.

We claim:

1. In combination:

a boat having a hull defining an inside area to be occupied by a user of the boat;

an outboard motor having a drive propeller; and means for mounting the outboard motor to the boat for movement relative to the boat between (a) an operative position wherein the propeller is submerged in a body of water on which the boat is buoyed and (b) a storage position wherein the outboard motor resides substantially entirely within the inside area of the hull, wherein said boat has a floor and a recess beneath said floor and said outboard motor resides entirely within said recess and beneath said floor in said storage position, wherein said floor has an opening communicating with the recess and further including a cover and means mounting the cover to the boat so that the cover covers at least a part of the floor opening with the outboard motor in its operative position, wherein with the outboard motor in its operative position the outboard motor mounting means extends through the floor opening and the cover has a first section to cover the part of the floor opening and a second section movable relative to the first cover section to selectively expose another part of the floor opening with the first cover section covering the part of the floor opening to thereby permit passage through the opening of the outboard motor mounting means with the outboard motor in its operative position.

2. The combination according to claim 1 wherein means mount the cover to the boat for movement between an open position wherein the floor opening is substantially completely exposed and a closed position wherein the first and second cover sections cooperatively substantially completely close the floor opening and provide a substantially continuous surface with the floor.

3. The combination according to claim 2 wherein means hingedly mount the first cover section to the boat and the second cover section hingedly to the first cover section.

4. The combination according to claim 3 wherein said first cover section and second cover section hingedly pivot about transverse axes.

5. A device for mounting an outboard motor to a boat for movement selectively relative to the boat between an operative position and a storage position, said mounting device comprising:

a first link;

means for mounting another portion of the first link to the boat for pivoting movement relative to the boat about a second axis that is spaced from and substantially parallel to the first axis;

a second link;

means for mounting one portion of the second link to the outboard motor for pivoting movement relative to the outboard motor about a third-axis which is substantially parallel to the first axis and spaced beneath the first axis with the outboard motor in its operative position; and means for mounting another portion of the second link to the boat for pivoting movement relative to the boat about a fourth axis that is substantially parallel to and located above the second axis, wherein at least one of said first and second links has a substantially straight, elongate configuration and an offset at one end thereof with a surface for bearing against a boat on which the device is mounted with an outboard motor associated with the device in an operative position.

* * * * *